US006234338B1

(12) United States Patent
Searle

(10) Patent No.: US 6,234,338 B1
(45) Date of Patent: May 22, 2001

(54) BEVERAGE CONTAINER CLOSURES

(76) Inventor: Matthew J. Searle, 74 High St., Bruton, Somerset (GB), BA10 0AJ ( * ) Notice: Subject to any disclaimer, the term of this patent is extended or adjusted under 35 U.S.C. 154(b) by 0 days.

(21) Appl. No.: 09/290,991

(22) Filed: Apr. 14, 1999

Related U.S. Application Data

(63) Continuation of application No. PCT/GB98/00942, filed on Mar. 27, 1998.

(30) Foreign Application Priority Data

| | | |
|---|---|---|
| Apr. 15, 1997 | (DE) | 9707563 |
| May 8, 1997 | (DE) | 9709221 |
| May 9, 1997 | (DE) | 9709363 |

(51) Int. Cl.[7] ..... B65D 41/04; B65D 51/14; B65D 51/16

(52) U.S. Cl. ..... 220/366.1; 215/307; 215/331; 215/902; 220/203.06; 220/290; 220/296; 220/298; 220/303

(58) Field of Search ..... 220/366.1, 231, 220/288, 290, 296, 300, 298, 303, 906, 319, 608, 203.04, 203.06; 215/260, 270, 271, 276, 307, 329, 331, 332, 333, 339, 902, 314, 231, 274

(56) References Cited

U.S. PATENT DOCUMENTS

| | | | | |
|---|---|---|---|---|
| 2,022,780 | * | 12/1935 | Peters | 220/296 |
| 2,449,014 | * | 9/1948 | Shaffer | 215/260 |
| 3,680,731 | * | 8/1972 | Lelyk et al. | 220/319 |
| 4,007,848 | * | 2/1977 | Snyder | 215/902 |
| 4,714,167 | * | 12/1987 | Sandhaus | 215/270 |
| 4,993,572 | * | 2/1991 | Ochs | 215/276 |
| 4,997,097 | * | 3/1991 | Krautkramer | 215/260 |
| 5,031,787 | * | 7/1991 | Ochs | 215/260 |
| 5,062,538 | * | 11/1991 | Ochs | 215/260 |
| 5,503,282 | * | 4/1996 | Montgomery | 215/252 |
| 5,533,633 | * | 7/1996 | King | 215/252 |
| 5,564,582 | * | 10/1996 | Kamath | 215/252 |
| 5,711,447 | * | 1/1998 | Plester | 220/254 |
| 5,785,196 | * | 7/1998 | Montgomery | 215/270 |
| 5,785,198 | * | 7/1998 | Credle, Jr. | 220/906 X |
| 5,816,422 | * | 10/1998 | Roig | 220/288 |
| 6,039,090 | * | 3/2000 | Gunn et al. | 220/240 X |

* cited by examiner

*Primary Examiner*—Stephen P. Garbe
*Assistant Examiner*—Niki M. Eloshway
(74) *Attorney, Agent, or Firm*—Nixon & Vanderhye PC

(57) ABSTRACT

A container for a carbonated beverage has an interrupted external screw thread surrounding its mouth opening engageable with an internal screw thread of a rotatable closure. The rotatable closure has a top member which is inwardly domed or indented or otherwise shaped to impart the necessary stiffness thereto. To prevent missiling on opening, pressure venting means are provided. Such pressure venting means may comprise slots extending through the closure, and/or the rotatable closure may be provided with stops which impart a two stage opening movement thereto. A rotatable closure with a low opening torque is made into parts and has a top member and a freely rotatable peripheral rim carried by the top member.

25 Claims, 4 Drawing Sheets

BEVERAGE CONTAINER CLOSURES

Figure 2:
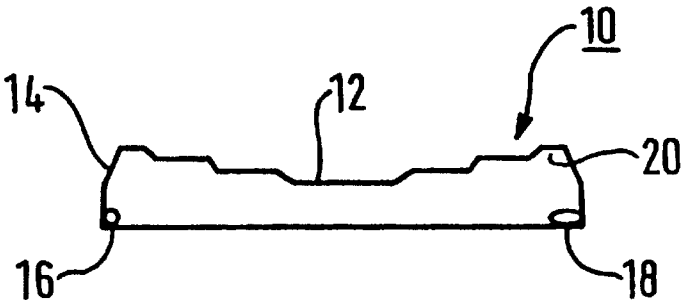

This application is a continuation of PCT/GB98/00942, filed Mar. 27, 1998.

The present invention relates to the use of a rotatable closure to close a container for carbonated beverages, to a container for carbonated beverages, and to a rotatable closure for a carbonated beverage container.

British patent No. 2,254,594 discloses a container for beer and other beverages which is particularly suitable for dispensing carbonated beverages to a large number of people at a public venue. The container disclosed in the identified British patent is made of plastics material and has an unrestricted mouth opening such that the container itself can be used as the drinking vessel. The opening has an external screw thread proximate thereto and the proposal of British patent No. 2,254,594 is to provide a correspondingly threaded end closure.

There are currently large numbers of designs of closures for containers, including many designs of closures arranged to be affixed and removed from the corresponding container by a screw action. However, none of the readily available closures behave entirely satisfactorily with a container of the type disclosed in the above identified British patent.

The present invention seeks to provide closures which can be used satisfactorily with carbonated beverage containers.

According to a first aspect of the present invention, there is provided the use of a rotatable closure to close a container for carbonated beverages, wherein said rotatable closure comprises a top member and a separate rim, the rim being held on the top member and being rotatable relative to the top member, and wherein said container has a body member having an opening at one end thereof, and external engagement means formed on said body member proximate to said opening, wherein cooperable engagement means are formed internally of the rim of said rotatable closure, and wherein the container opening is closed by engaging the engagement means of said rim with the engagement means of the container.

The use of a rotatable closure of an embodiment of the invention, which has a separate, rotatable, rim ensures that the container can be reliably closed against the pressure of its contents, and yet be opened relatively easily. In this respect, to open the container it is only necessary to rotate the rim and not the top member of the closure. If the container has a wide mouth opening, the top member forms a large part of the closure. By this means, the opening torque of the closure is reduced quite considerably.

The container may be fabricated from any suitable material, for example, from metal or glass. In a preferred embodiment, the container is fabricated from plastics material.

Preferably, said opening defines an unrestricted mouth opening for the container. For example, the opening may have a diameter exceeding 30 mm, or 50 mm.

In an embodiment, said cooperable engagement means on said rim and on the container are arranged such that said rotatable closure is engageable and removable from the container by rotating the rim of the rotatable closure relative to the opening of the container.

As explained, the rotatable closure is removable from the container by rotation of the rim, and preferably, rotation of said rim through less than one complete revolution thereof is effective to enable removal of the closure.

In one embodiment, the cooperable engagement means comprises an external screw thread provided on said container around said opening. The screw thread on the container may be continuous or interrupted. The screw thread on the container may vary in pitch.

The cooperable engagement means on the interior of the rim of the closure, for cooperation with the screw thread, for example, on the container, may comprise a plurality of lugs and/or an internal screw thread.

In a preferred embodiment, a plurality of lugs are spaced around the opening of the container, and an internal screw thread is provided on the interior of the rim of the closure for cooperation with said lugs.

Preferably, to prevent missiling of the closure on opening, pressure venting means are associated with the closure. For example, said pressure venting means may comprise one or more slots extending through said closure, and/or through said container.

Additionally and/or alternatively, said pressure venting means comprise means associated with said cooperable engagement means for imparting a two stage opening movement to said rotatable closure relative to the opening of the container.

The present invention also extends to a container for carbonated beverages comprising a body member having an opening at one end thereof, and external engagement means formed on said body member proximate to said opening, and a rotatable closure engaged on said container to close the opening, the rotatable closure comprising a top member and a depending rim, and wherein cooperable engagement means are formed internally of the rim of said rotatable closure and engage the external engagement means to hold the rotatable closure on the container.

As previously, the body member may be of any suitable material, for example of glass or metal. However, for use at public venues it is preferred that the body member be fabricated of plastics material.

The rotatable closure defined above, and the rotatable closure incorporated in an embodiment of a container of the invention, may be fabricated, at least in part, of metal. Closures incorporating metal generally have a lower coefficient of friction than closures made entirely of plastics material and the use, therefore, of metal reduces the opening torque.

The rim of the rotatable closure may be made of any suitable material, for example, of plastics or of metal.

The top member of the rotatable closure is preferably suitably shaped to provide stiffness thereto.

In a preferred embodiment, the top member of the rotatable closure is deformed inwardly. This deformation provides the closure with a large surface area and thereby stiffens the closure and enables it to withstand the pressure of the carbonated contents of the container.

In a preferred embodiment, the inward deformation of the top member is utilised to form a seal between the closure and the container.

Preferably, the engagement between the rotatable closure and the container is arranged such that the closure may be removed by rotating it through less than one complete revolution thereof. This ensures quick and easy removal of the closure, a feature which is very important if the container is being used to dispense beverages at a public venue.

The container is also, preferably, provided with pressure venting means to prevent missiling of the closure. Preferably, the pressure venting means are associated with the closure. For example, slots may extend through the closure and/or the container. In one embodiment, these slots are adjacent to the engagement means of the closure.

Additionally and/or alternatively, means may be associated with the engagement means of the closure to impart a two stage opening movement thereto. For example, such means may be arranged to halt an opening movement of the closure relative to the container opening. For example, appropriate stops may be provided on the closure and/or on the container. As the closure is rotated to effect opening, part of the closure or of the container will abut against the stops. This arrest of the opening movement is designed to provide for pressure venting. The effect of the stops can be overcome by, for example, pressing down on the closure whereby the rest of the opening rotation is enabled.

In an embodiment, cooperable engagement means on said rim and on the container are arranged such that said rotatable closure is engageable and removable from the container by rotating the rotatable closure relative to the opening of the container. For example, said rotatable closure may be removable by rotating said closure relative to the periphery of the opening, and wherein rotation of said closure through less than one complete revolution thereof is effective to enable its removal.

Preferably, the cooperable engagement means comprises an external screw thread provided on said container around said opening. The screw thread on the container may be continuous or interrupted.

The cooperable engagement means on the interior of the rim of the closure, for cooperation with the screw thread, for example, on the container, may comprise a plurality of lugs and/or an internal screw thread.

In an alternative embodiment, the cooperable engagement means comprise an internal screw thread on the rim of said rotatable closure.

Said screw thread on the rim may be interrupted, and/or may vary in pitch.

In this embodiment, said cooperable engagement means further comprise a plurality of lugs provided on said container and spaced around said opening, said lugs being engageable with said internal screw thread.

The container as defined above may have any of the features of the use of the rotatable closure as defined above, and/or any of the features of the rotatable closure as defined below.

Similarly, the use of the rotatable closure as defined above may incorporate any of the features of the container as defined above, and/or any of the features of the rotatable closure as defined below.

The present invention also extends to a rotatable closure for a carbonated beverage container, said rotatable closure comprising a top member, and a peripheral rim depending relative to said top member, and wherein the top member is shaped to stiffen the closure.

In an embodiment, said peripheral rim is separate from the top member and is held on the top member to be rotatable around the periphery thereof.

The rotatable closure may be fabricated and configured as defined above.

Figure 3:
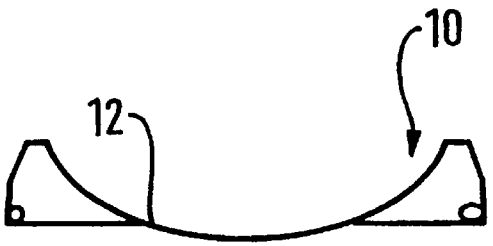
Figure 1:
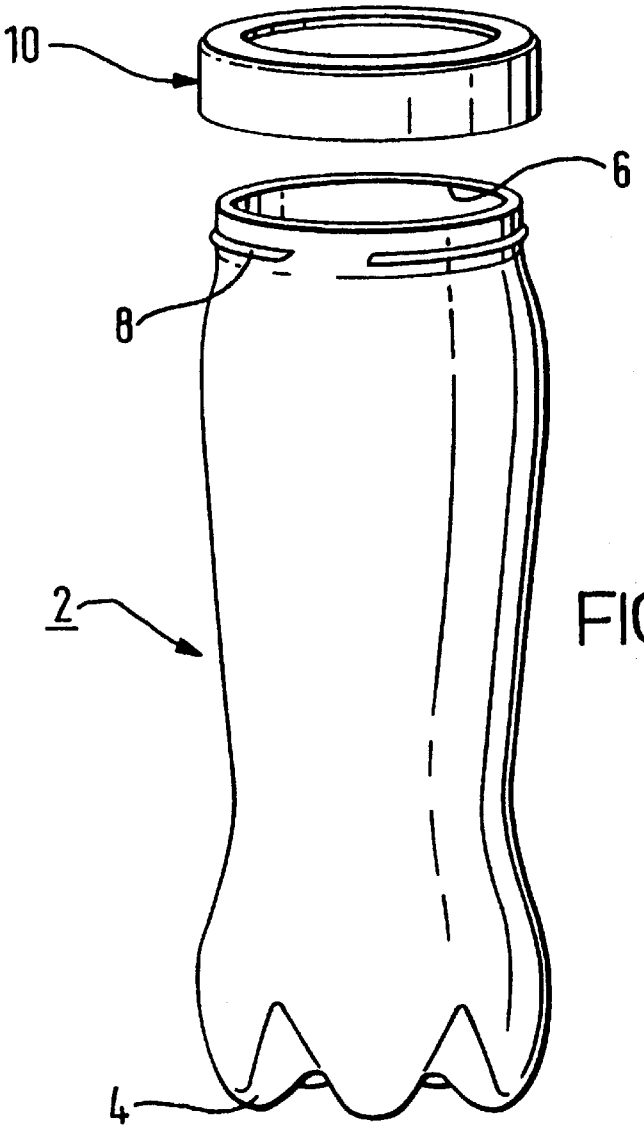
Figure 4A:
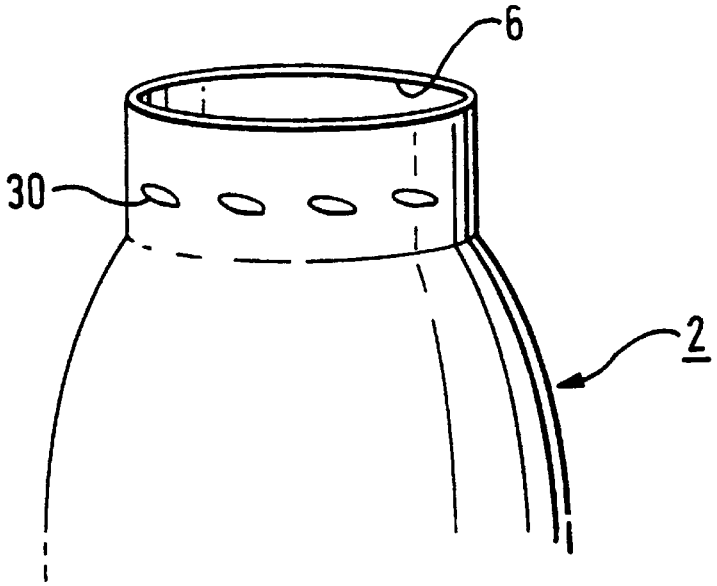
Figure 4B:
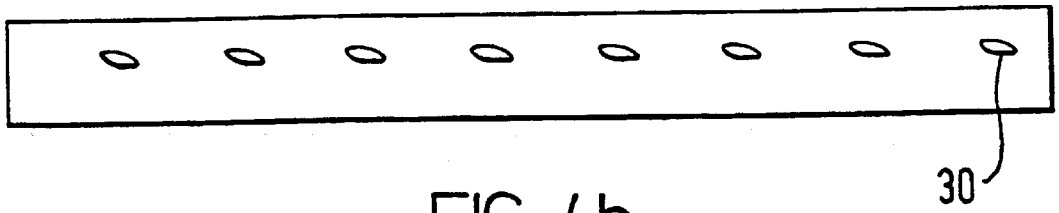
Figure 4C:
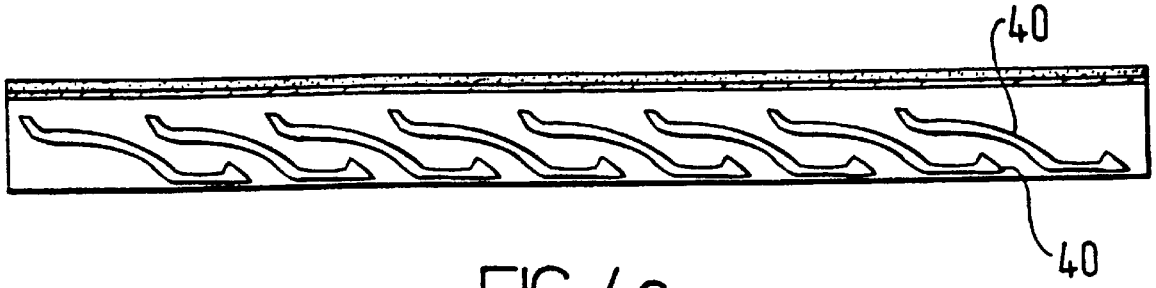
Figures 5A, 5B:
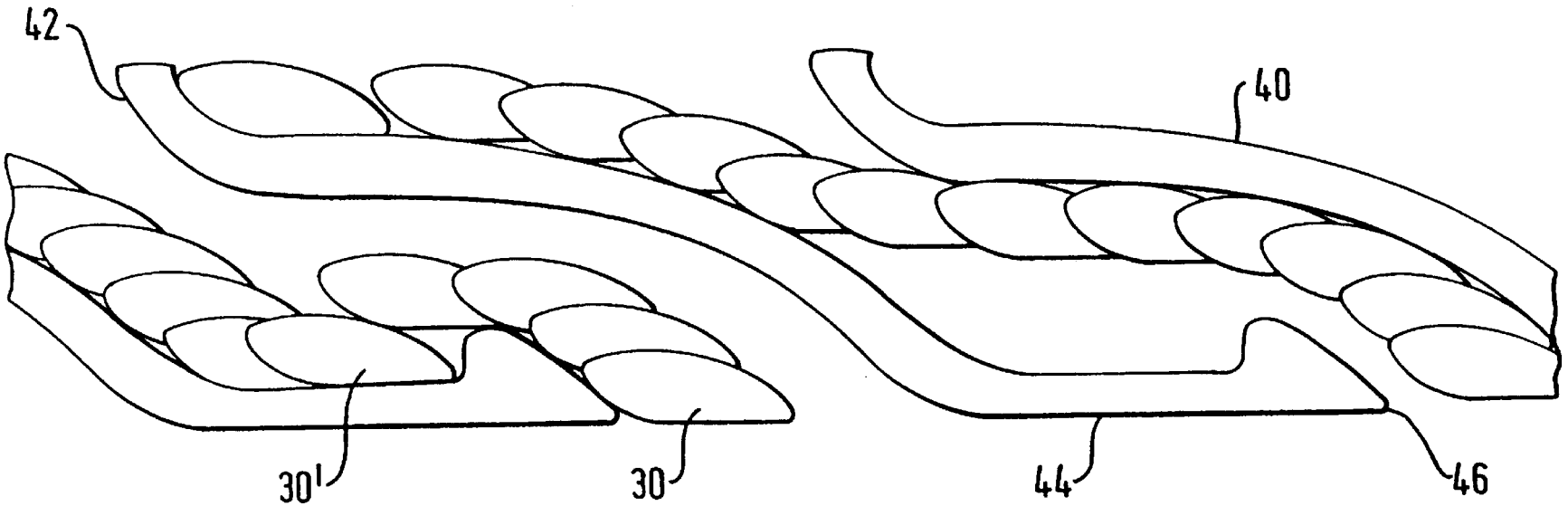
Figure 6:
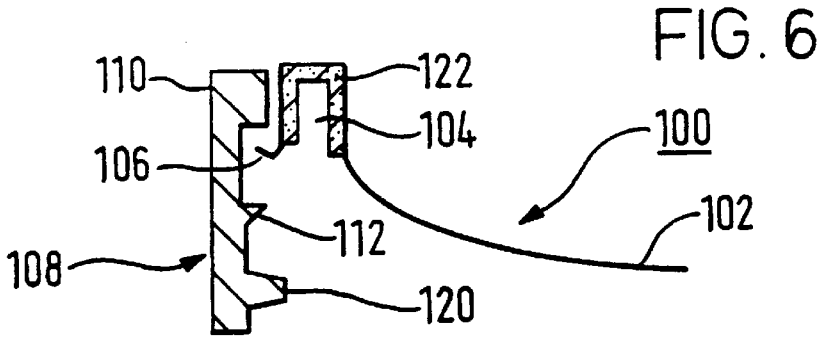
Figure 7:
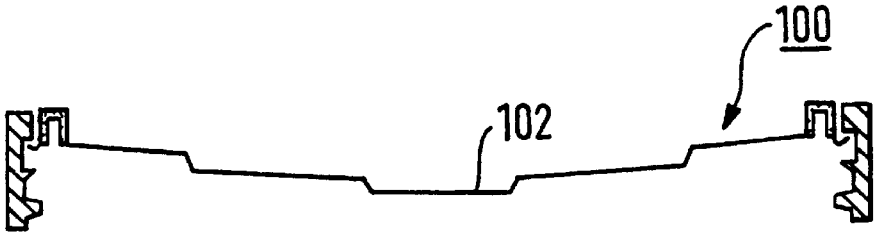
Figure 8:
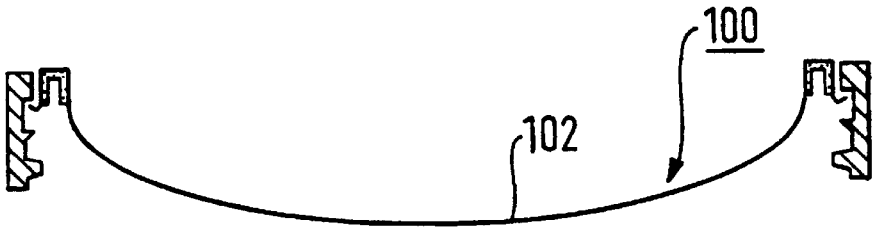
Figure 9:
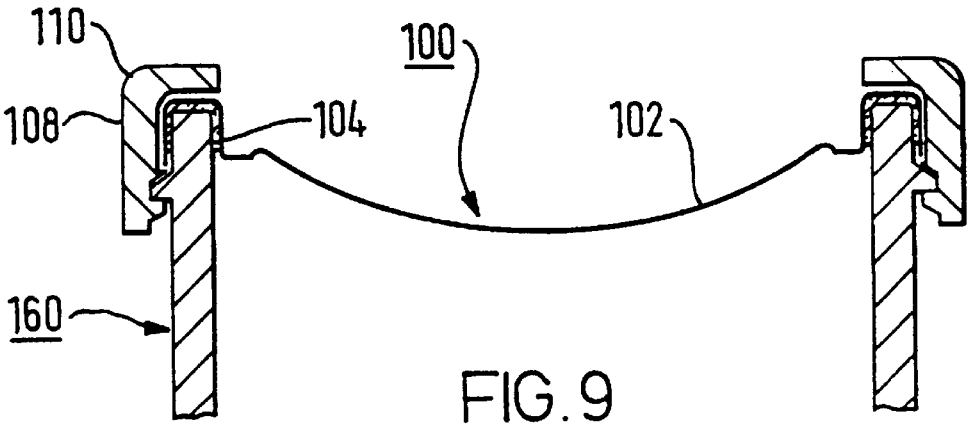

Embodiments of the present invention will hereinafter be described, by way of example, with reference to the accompanying drawings, in which:

FIG. 1 shows schematically a carbonated beverage container with a closure therefor, FIG. 2 shows schematically a first embodiment of a rotatable closure for use with a carbonated beverage container, FIG. 3 shows schematically a further embodiment of a rotatable closure, FIGS. 4*a*, 4*b*, and 4*c* show respectively the mouth opening of a container having engagement means in the form of a series of lugs, an extended view of the mouth opening, and an extended view of the internal surface of a closure cooperable therewith, FIGS. 5*a* and 5*b* show schematically part of a thread provided on a rotatable closure and the lugs on the container mouth opening, and illustrate the closing and opening movements of the closure, FIG. 6 shows a section through an alternative embodiment of a closure of the invention, FIG. 7 shows a further rotatable closure of the type shown in FIG. 6, FIG. 8 shows a still further embodiment of a rotatable closure of the type shown in FIG. 6, and FIG. 9 shows an alternative embodiment of a rotatable closure of the type shown in FIG. 6.

The invention is described herein specifically with reference to a carbonated beverage container of plastics material as described, for example, in UK patent No. 2,254,594. However, whilst the present invention has been specifically designed for use with such a container, the invention is not limited to containers as described and claimed in the British patent. For example, a carbonated beverage container of the invention may be made of a plastics material, or of glass, or of metal, or of any other suitable material.

FIG. 1 shows an example of a beverage container of plastics material for use for dispensing beer or other carbonated beverages. In this respect, the container comprises of substantially cylindrical body member 2 of plastics material having a closed end 4 and a generally circular mouth opening 6 at the end thereof opposed to said closed end 4. An interrupted external screw thread 8 is provided on the body member 2 and surrounds, but is spaced from, the mouth opening 6.

The container of FIG. 1 is also provided with a closure 10 having an internal screw thread (not visible) arranged to engage the screw thread 8 of the container. Thus, when the body member 2 has been filled, the closure 10 can be engaged thereon by engaging the screw threads of the closure and of the body member and then rotating or screwing the closure to its closed position. When it is required to have access to the contents of the container, the closure 10 is removed and may be discarded.

The construction and configuration of the closure 10, and the method of its engagement on the container, has to be chosen with care to meet a number of desired criteria. It is, of course, required that the closure 10 is able to withstand the pressure of the contents of the container when the container has been filled with a carbonated beverage. However, it is also generally required that the closure can be removed quickly. Where the closure is engaged by rotation or by screw action, the requirement for easy and speedy access generally means that the closure should not have to be rotated more than one complete revolution in order to release it. However, in general, the smaller the amount of revolution required to remove the closure, the greater the danger that the closure will be missiled off due to the pressure of the container contents.

Similarly, it is required that there be a seal between the closure and the container when the container is closed in order to keep the beverage pressurised. However, the greater and more effective the seal, the greater the risk that the required opening torque will be unacceptably large.

FIG. 2 illustrates a first embodiment of a rotatable closure 10 for use with a container as indicated in FIG. 1. The closure 10 shown in FIG. 2 is made of metal, for example, of steel. In this respect, metal in general, and steel in particular, has a lower coefficient of friction than plastics material such that the opening torque of a closure 10 as shown in FIG. 2 will be less than that of a comparative closure made of plastics material.

The rotatable closure 10 illustrated in FIG. 2 has a top member 12 from which a rim 14 depends. The free edge 16 of the rim 14 is rolled and is intermittently deformed to form a plurality of lugs as 18. These lugs 18 are arranged to engage with the screw thread 8 on the body member 2 of the container. Where the screw thread 8 is interrupted, for example as shown in FIG. 1, the lugs 18 may be spaced apart by a distance substantially the same as the length of each length of the screw thread 8.

It will be appreciated that the rotatable closure 10 of FIG. 2 can be engaged with the body member by a screw action which is effective to position each lug 18 beneath a length of the screw thread 8. Removal of the closure 10 is effected by a reverse screw action.

The rotatable closure 10 has a top member 12 which is shaped to provide stiffness to the construction and, therefore, to provide the ability for the closure 10 to withstand the pressure within the beverage container. In this respect, the top member 12 may have any suitable shape which imparts the necessary stiffness. For example, a double curve may be imposed on the top member and/or a star shape may be impressed therein. Frequently, shapes in which the top member 12 is inwardly deformed will be used as such shapes facilitate the incorporation of sealing means as described further below.

As can be seen, in the embodiment of FIG. 2, the top member 12 is inwardly indented. In this respect, the indentation of the top member 12 is arranged to define between the top member 12 and the rim 14 an annular channel 20. This channel 20 is sized and configured so that it is capable of receiving the upper annular surface of the mouth opening 6 of the container. If required, a sealing member, such as a rubber ring (not shown) may be housed within the channel 20. Alternatively, a sealing compound may be provided within the channel 20.

FIG. 3 shows a further embodiment of a rotatable closure 10 which is similar to that of FIG. 2. However, and as will be seen, in the embodiment of FIG. 3 the top member 12 is inwardly domed.

The embodiments described so far show the use of an interrupted screw thread on the body member 2 of the container for engagement with a screw thread or with lugs provided on an inner surface of a rim of the closure. However, it will be appreciated, that any cooperable engagement means, which enable the closure to be reliably engaged on the container, and enable removal of the closure by a twisting action may be utilised. For example, threads may be provided on the body member or on the closure and such threads may be continuous or interrupted. The other of the closure and the body member may be provided with cooperating threads, with lugs, recesses, guides, or other formations.

However, there is an advantage to utilising a screw thread on one of the container and the closure, and lugs on the other of the closure or container, as such an arrangement enables pressure venting for the closure to be provided.

In this respect, FIG. 4*a* shows part of the body member 2 of a container having a plurality of lugs 30 provided externally of the body member 2 and around the mouth opening 6. FIG. 4*b* shows an extended view of the neck showing the lugs 30, whereas FIG. 4*c* shows an extended view of the inner cooperating surface of a closure, as 10, which is provided with an interrupted screw thread 40. This closure 10 is to be used with the body member 2 of FIG. 4*a*.

FIGS. 5*a* and 5*b* show adjacent sections or lengths of the interrupted screw thread 40 provided on the inner surface of the closure 10. As can be seen, the lengths of the screw thread 40 are shaped to guide the lugs 30 during opening and closing, and at one end, each length of the screw thread 40 has an angle flat section 42 and at its other end, each length of screw thread 40 has a further flat 44 terminated in a stop 46. A lug 30 of the body member 2 of the container will lie on a respective angle flat 42 in the closed condition of the closure.

When the closure 10 is to be opened, it is rotated relative to the mouth opening 6 whereby each lug 30 is moved along the corresponding length of the screw thread 40 until the lug 30 is received in the position 30'. In that position, the stop 46 prevents further relative rotation between the closure and the container. However, if the closure is then pressed downwardly, the lug 30 is positioned above the stop 46, and further rotation of the closure, and hence its removal, can be achieved. This two stage opening of the closure allows pressure to be vented whilst the closure and the container are still engaged. Thus, the stops 46 are effective as anti-missiling stops.

It will be appreciated that in the arrangement shown in FIGS. 5*a* and 5*b*, the lengths of screw thread 40 are shaped to have a variable pitch. By this means, the removal of the closure from the body member employs a camming action derived from the variation in pitch. Of course, alternative constructions can be provided.

The particular screw thread and lug configuration illustrated is arranged to enable removal of the closure upon rotation thereof through less than one complete revolution. Preferably, removal is arranged to occur after about one quarter of one revolution of the closure.

FIG. 6 shows an embodiment of an alternative closure 100 which is a two-part closure. Thus, the closure 100 comprises a top member 102, for example, made of a metal, which is generally in the form of a circular disc but has an annular channel 104 provided therein. Furthermore, the top member 102 is also formed to have a radially extending flange 106. The top member 102 carries a depending peripheral rim 108 which has two axially spaced, radially extending flanges 110 and 112 engageable with the flange 106 of the top member to hold the rim 108 relative to the top member 102. On the internal annular surface of the rim 108, engagement means, such as a screw thread 120, are provided. In this respect, the closure 100 may have any or all of the features of the previously described closures. It differs from the previous closures in that it is in two parts and in that the rim 108 is held on the top member 102 to be freely rotatable relative thereto.

When the closure 100 is in position closing a container, the periphery of the container's mouth opening, as 6, is preferably received within the annular channel 104 as earlier described. In this respect, and as indicated in FIG. 6, a sealing compound 122 may be received within the channel 104. The sealing of the container in the closed position of the closure 100 can thereby be ensured.

To open a container closed by the closure 100, the rim 108 is grasped, in normal manner, and is rotated relative to the container. However, whereas with a one part closure the whole of the closure has to be rotated, opening of the container utilising a closure as 100 can be achieved by rotation of the rim 108 only whereby the opening torque is considerably reduced.

The closure 100 shown in FIG. 6 may be provided with pressure venting means, for example, in the form of slots (not shown) extending through the rim 108 from its inner to its outer surface. Such slots, for example, may extend upwardly from an opening in the inner surface of the rim 108 and exit in the flange 110. When the rim 108 is rotated to open the container, the action of the screw thread 120 on the corresponding thread or lugs of the container lifts the closure and may be sufficient to partially or fully break any seal between the closure and the container. This enables pressure from the interior of the container to be vented by way of the vent slots in the closure. Continued rotation of the rim 108 then effects removal of the closure 100.

Of course, the pressure venting slots may be incorporated in any suitable area of the closure and/or container. For example, pressure venting slots may extend through the screw thread 120 of the closure, and/or through the corresponding screw thread or other engagement means of the container.

The rim 108 of the closure may be made of any suitable material. For example, the rim 108 may be made of a plastics material. Alternatively, the rim 108 may be made of metal, for example, it may be a spun or pressed metal threaded band.

FIG. 7 shows schematically an alternative embodiment of the closure 100 in which the top member 102 is inwardly deformed. In the embodiment shown in FIG. 7, the top member 102 is inwardly indented. FIG. 8 shows an alternative embodiment in which the top member 102 is inwardly domed. In both of the embodiments of FIGS. 7 and 8, the inward deformation of the top member 102 increases the surface area of the top member and hence increases the stiffness of the closure and its ability to withstand pressure as described earlier.

FIG. 9 shows a still further embodiment of the closure 100 in which the radially extending flange 110 of the rim 108 extends over the top member 102. In the embodiment illustrated in FIG. 9, the periphery of the mouth opening of a container 160 is shown received within the annular channel 104 of the closure 100.

It will be appreciated that variations to and modifications in the embodiments as described and illustrated may be made within the scope of the invention as defined in the appended claims.

What is claimed is:

1. The combination of a container for a carbonated beverage and a rotatable closure for the container, the container comprising a body member fabricated from plastics material and having an opening at one end thereof, said opening having an annular periphery and defining an unrestricted mouth opening for the container, the rotatable closure comprising a top member having a periphery and a separate depending rim, the rim being engageable with the periphery of the top member and being rotatable relative to the top member, and the combination further comprising first external engagement means formed on said body member proximate to said opening and second engagement means formed internally of the rim of said rotatable closure, said first and second engagement means being engageable to allow said rotatable closure to be engaged on and removed from the container by rotating the rim of the rotatable closure relative to the opening of the container, wherein the rotatable closure is selectively rotatable to a closed position that closes and seals said opening and being arranged, in said closed position, to withstand a pressure of and substantially maintain a pressurized state of the contents of the container when the container has been filled with a carbonated beverage, wherein a downwardly open annular channel extends around the periphery of the top member of said rotatable closure, the annular periphery of the container opening being received within said annular channel in the closed position of the rotatable closure to seal said opening wherein pressure venting means are defined by at least one of said container and said rotatable closure, for allowing pressure to be vented from the interior of the. container upon rotation of said rim of said rotatable closure out of said closed position during opening of the container, wherein the top member of said rotatable closure is shaped to stiffen the closure, and wherein said top member is inwardly domed.

2. A combination according to claim 1, wherein said pressure venting means comprise one or more discontinuities in said second engagement means.

3. A combination according to claim 1, wherein said pressure venting means comprise one or more discontinuities in said first engagement means.

4. A combination according to claim 1, wherein said first and second engagement means define a two stage opening movement of said rotatable closure relative to the opening of the container, the first stage of the opening movement providing said pressure venting and the second stage providing for removal of the rotatable closure from the container.

5. A combination according to claim 1, wherein said unrestricted mouth opening for the container has a diameter which exceeds 30 millimeters.

6. A combination according to claim 5, wherein said unrestricted mouth opening has a diameter exceeding 50 millimeters.

7. A combination according to claim 1, wherein the top member of said rotatable closure is made of metal.

8. A combination according to claim 1, wherein the separate depending rim of the rotatable closure is made of a plastics material.

9. A combination according to claim 1, wherein the separate depending rim of the rotatable closure is made of metal.

10. A combination according to claim 1, wherein said rotatable closure is removable from the container by rotating the rim of the rotatable closure relative to the opening of the container, and wherein rotation of said closure through less than one complete revolution thereof is effective to enable its removal.

11. A combination according to claim 10, wherein rotation of the rim of said rotatable closure through about one quarter of one revolution is effective to enable removal of the rotatable closure.

12. A combination according to claim 1, wherein said first and second engagement means comprise lugs and/or stops provided on one of the rim and of the container, and corresponding recesses, guides and/or stops provided on the other of the container and of the rim.

13. A combination according to claim 1, wherein said first engagement means comprises an external screw thread provided on said container around said opening.

14. A combination according to claim 13, wherein said external screw thread on the container is interrupted.

15. A combination according to claim 13 or claim 14, wherein said second engagement means further comprises a plurality of lugs on the interior of the rim of said rotatable closure for engagement with said external screw thread.

16. A combination according to claim 13 or claim 14, wherein said second engagement means comprises an internal screw thread on the rim of said rotatable closure for engagement with said external screw thread.

17. A combination according to claim 1, wherein said second engagement means comprise an internal screw thread on the rim of said rotatable closure.

18. A combination according to claim 17, wherein said internal screw thread is interrupted.

19. A combination according to claim 17 or claim 18, wherein said screw thread varies in pitch.

20. A container according to claim 17, wherein said first engagement means comprise a plurality of lugs provided on said container and spaced around said opening, said lugs being engageable with said internal screw thread.

21. A combination according to claim 1, wherein said second engagement means are formed on an inner surface of said rim of the rotatable closure, and said pressure venting means are defined by said second engagement means.

22. A combination according to claim 1, wherein said pressure venting means comprise at least one slot defined in said rim of the rotatable closure.

23. A combination according to claim 21 or claim 22, wherein said pressure venting means comprise means defined by said second engagement means and arranged to effect a two stage opening movement of said rotatable closure.

24. A combination according to claim 21 or claim 22, wherein said pressure venting means comprise at least one anti-missiling stops associated with said second engagement means.

25. The combination of a container for a carbonated beverage and a rotatable closure for the container, the container comprising a body member fabricated from plastics material and having an opening at one end thereof, said opening having an annular periphery and defining an unrestricted mouth opening for the container, the rotatable closure comprising a top member having a periphery and a separate depending rim, the rim being engageable with the periphery of the top member and being rotatable relative to the top member, and the combination further comprising first external engagement means formed on said body member proximate to said opening and second engagement means formed internally of the rim of said rotatable closure, said first and second engagement means being engageable to allow said rotatable closure to be engaged on and removed from the container by rotating the rim of the rotatable closure relative to the opening of the container, wherein the rotatable closure is selectively rotatable to a closed position that closes and seals said opening and being arranged, in said closed position, to withstand a pressure of and substantially maintain a pressurized state of the contents of the container when the container has been filled with a carbonated beverage, wherein a downwardly open annular channel extends around the periphery of the top member of said rotatable closure, the annular periphery of the container opening being received within said annular channel in the closed position of the rotatable closure to seal said opening, and wherein pressure venting means are defined by at least one of said container and said rotatable closure, for allowing pressure to be vented from the interior of the container upon rotation of said rim of said rotatable closure out of said closed position during opening of the container.

* * * * *

UNITED STATES PATENT AND TRADEMARK OFFICE

CERTIFICATE OF CORRECTION

PATENT NO. : 6,234,338 B1
DATED : May 22, 2001
INVENTOR(S) : Searle

It is certified that error appears in the above-identified patent and that said Letters Patent is hereby corrected as shown below:

Title page,

Item [30] Foreign Application Priority Data,

| | | |
|---|---|---|
| Apr 15, 1997 | (GB)..... | 9707563.4 |
| May 8, 1997 | (GB)..... | 9709221.7 |
| May 9, 1997 | (GB)..... | 9709363.7 |

The listing of references cited should include the following:

Item [56] References Cited,

U.S. PATENT DOCUMENTS

| | | |
|---|---|---|
| 4,093,094 | 06/1978 | Smalley et al |
| 4,679,696 | 07/1987 | Bonnenfant |
| 4,721,219 | 01/1988 | Dullabaun et al |
| 4,880,127 | 11/1989 | Doi |

FOREIGN PATENT DOCUMENTS,

| | | |
|---|---|---|
| 0170601 | 02/1986 | European Patent |
| 0201613 | 11/1986 | European Patent |
| 0269920 | 06/1988 | European Patent |
| 2154451 | 09/1985 | United Kingdom |
| 2254594 | 10/1992 | Great Britain |
| 97/21602 | 06/1997 | PCT |

OTHER PUBLICATIONS,

Product Leaflet, Combo Cap, Italcaps

Signed and Sealed this

Twenty-ninth Day of January, 2002

*Attest:*

*Attesting Officer*

JAMES E. ROGAN

*Director of the United States Patent and Trademark Office*